United States Patent [19]

Landa

[11] 4,396,187

[45] Aug. 2, 1983

[54] SHEET DETECTOR FOR ELECTROPHOTOGRAPHIC COPIER

[75] Inventor: Benzion Landa, Edmonton, Canada

[73] Assignee: Savin Corporation, Valhalla, N.Y.

[21] Appl. No.: 336,571

[22] Filed: Jan. 4, 1982

Related U.S. Application Data

[63] Continuation of Ser. No. 120,475, Feb. 11, 1980, abandoned.

[51] Int. Cl.[3] ..... B65H 7/02

[52] U.S. Cl. ..... 271/258; 271/265; 271/270

[58] Field of Search ..... 271/258, 259, 265, 270; 226/11, 25, 39

[56] References Cited

U.S. PATENT DOCUMENTS

| | | | |
|---|---|---|---|
| 3,071,373 | 1/1963 | Di Veto | 271/259 |
| 3,696,982 | 10/1972 | Gottschall | 226/25 |
| 3,764,050 | 10/1973 | Clark | 226/25 |
| 4,049,340 | 9/1977 | Krumbein | 226/25 X |

*Primary Examiner*—Richard A. Schacher
*Attorney, Agent, or Firm*—Shenier & O'Connor

[57] ABSTRACT

Sheet detecting apparatus for use in sheet feeders in which sheets are fed through first and second pairs of feed rollers longitudinally spaced from each other by less than the length of a sheet. The presence of a sheet spanning both pairs of rollers is sensed by driving the downstream pair of rollers at a slightly greater linear speed than the upstream pair of rollers and sensing at the second pair of rollers the retarding torque transmitted through the sheet of paper from the first pair of rollers.

9 Claims, 3 Drawing Figures

SHEET DETECTOR FOR ELECTROPHOTOGRAPHIC COPIER

This is a continuation of application Ser. No. 120,475, filed on Feb. 11, 1980 now abandoned.

BACKGROUND OF THE INVENTION

This invention relates to apparatus for sensing the position of a sheet along a feed path and, especially, to apparatus for sensing the movement of a sheet edge past a pair of feed rollers such as feed rollers of an electrophotographic copier.

In sheet-feeding apparatus it is often desirable to sense when the leading or trailing edge of a sheet has passed a given point. In particular, it is often necessary to sense either that the leading edge of a sheet has entered a pair of opposing feed rollers or that the trailing edge has emerged from a pair of feed rollers. It is common in the art to sense the presence of a sheet either by mechanical feelers which extend into the feed path and are pushed out of the way by a sheet or by photoelectric devices which sense the interruption of a radiant beam such as a light beam directed across the sheet path. All of these expedients suffer from one or more deficiencies which adversely affect reliability of operation.

Mechanical devices such as feelers that are delicate enough not to affect adversely the progress of the sheet being fed may not be as positive in opening or closing an electric circuit as desired. Photoelectric devices on the other hand, while not presenting an obstacle in the paper path, may in time operate unreliably either because of electrical component failure or because of buildup of dirt or grease which obstructs the light path.

Besides the problems of reliability, sensors of the type described above are not readily adaptable precisely to detect the movement of a sheet edge past the nip between a pair of feed rollers.

SUMMARY OF THE INVENTION

One of the objects of my invention is to provide a sheet detector which is positive and certain in operation.

Another object of my invention is to provide a sheet detector which does not cause the sheet to misfeed.

Yet another object is to provide a sheet detector which is simple and inexpensive.

A further object of my invention is to provide a sheet detector which is especially suited for detecting the movement of a sheet edge past the nip between a pair of feed rollers.

Other and further objects of my invention will be apparent from the following description.

In general, my invention contemplates sheet detecting apparatus in which a first element grips a sheet to move it along a feed path, while a second element having a longitudinal spacing from the first element less than the length of a sheet grips the sheet along the path to oppose the action of the first element. A sensor associated with one of the gripping elements senses the driving or retarding force, as the case may be, transmitted through the sheet of paper from the other gripping element to detect the presence of the sheet between the two gripping elements.

Preferably, the gripping elements comprise respective pairs of opposing feed rollers which are disposed along the sheet feed path at longitudinally spaced locations and which are driven at slightly different peripheral velocities in the feed direction so as to tension a sheet spanning both pairs of rollers. Further, I preferably sense the driving or retarding force by driving one of the pairs of rollers through a train of gears and measuring the force exerted by an intermediate gear on its associated mounting assembly. This force is conveniently measured by rotatably mounting the intermediate gear on the end of an arm pivoting about the axis of an adjacent gear and sensing the torque exerted by the intermediate gear on the arm about its pivot axis. A pressure-sensitive switch abutting the pivot arm may be used to sense this torque.

In my sheet detector, the sheet of paper spanning the two gripping elements can transmit an appreciable longitudinal force from one gripping element to the other, thereby insuring reliable and positive actuation of the switch or other sensor. On the other hand, since the only part of the sheet subjected to mechanical force from the sensor is already between the two gripping elements, that mechanical force, even if relatively large, cannot result in sheet misfeed. By contrast, prior art arrangements employing a mechanical feeler extending into the feed path to intercept the leading sheet edge tend to deflect that edge from the feed path, and thus inherently contribute to sheet misfeed. My sheet detector is, furthermore, operable precisely upon the movement of a sheet edge past a pair of feed members, rather than only approximately so as when mechanical or photoelectric sensors are used. Finally, since many of the components of my sheet detector are existing parts of the sheet feeder, the additional complexity and hence expense are minimized.

BRIEF DESCRIPTION OF THE DRAWINGS

In the accompanying drawings which form part of the instant specification and which are to be read in conjunction therewith and in which like reference numerals are used to indicate like parts in the various views.

DETAILED DESCRIPTION OF THE PREFERRED EMBODIMENT

Figure 1:
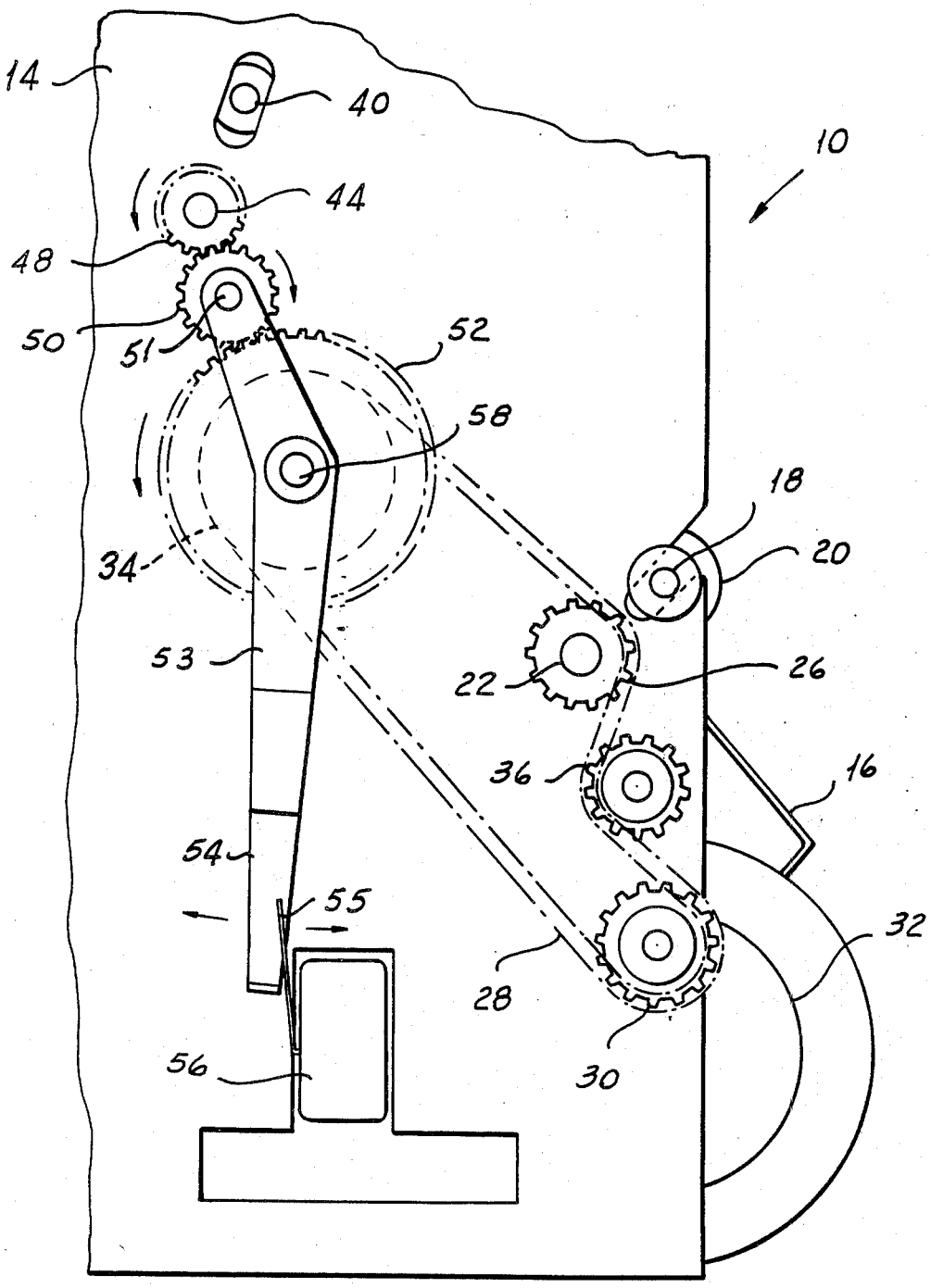
FIG. 1 is a fragmentary rear elevation of one embodiment of my sheet detector intended for use with an electrophotographic copier.
Figure 3:
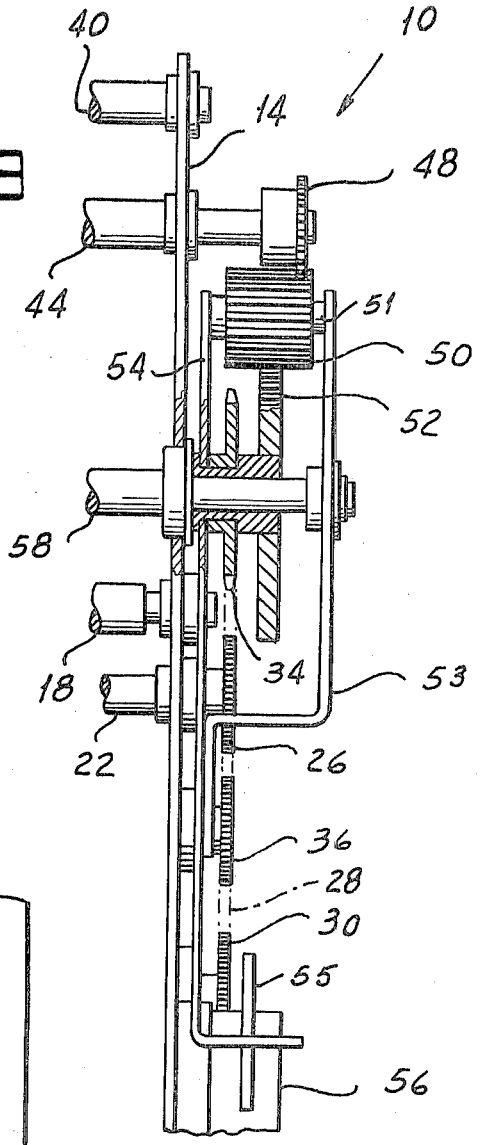
FIG. 3 is a fragmentary right side elevation of the rear portion of the sheet detector shown in FIG. 1.

Referring now to the drawings, my sheet detector, indicated generally by the reference numeral 10, receives sheets from any suitable source, such as the copy sheet exit assembly of an electrophotographic copier (not shown) and directs sheets received thereby to, for example, the output copy tray (not shown) of the copier. A lower guide 16 disposed between front and rear sidewalls 12 and 14 of the detector 10 directs a sheet P upwardly at about a 45° angle between transversely spaced rollers 20 mounted on a shaft 18 and opposing transversely spaced rollers 24 mounted on a shaft 22 below rollers 20. Preferably at least one of each pair of opposing rollers 20 and 22 is formed of a relatively compliant material to allow for variations in sheet thickness and compliance. Lower roller shaft 22 extends beyond rear sidewall 14 to receive a sprocket wheel 26. Sprocket wheel 26 engages a drive chain 28 which in turn is trained around a sprocket wheel 30 driven by a motor 32 carried inboard of sidewall 14. Drive chain 28 also extends around a sprocket wheel 34 rotatable about a shaft 58 and around an idler sprocket wheel 36.

After emerging from rollers 20 and 24, the leading edge of the sheet of paper P follows a second or upper guide 38 arranged generally in the same plane as lower guide 16. Upper guide 38 directs the sheet into the nips between transversely spaced rollers 42 mounted on a shaft 40 and opposing transversely spaced rollers 46 mounted on a shaft 44 below rollers 42. Rollers 42 and 46 are so spaced from rollers 20 and 24 that the leading edge of the sheet engages rollers 42 and 46 before the trailing edge clears rollers 20 and 24. Rollers 42 and 46 feed the sheet to any suitable destination such as the stacking tray shown in my copending application Ser. No. 120,474, filed Feb. 11, 1980. For purposes of simplicity, I have shown only one of each of the rollers 20, 24, 42 and 46 in the drawings.

Shaft 44 extends beyond sidewall 14 to receive a gear 48. Gear 48 engages a gear 50 which engages a gear 52 which rotates along with sprocket wheel 34 about shaft 58. I mount the intermediate gear 50 for rotary movement on a shaft 51 extending between a bracket 53 and the upper arm of a bell crank 54 to which bracket 53 is secured by any suitable means such as welding or the like. Bell crank 54 is rotatable on shaft 58 thus to mount intermediate gear 50 for planetary movement around gear 52. The lower end of bell crank 54 carries a lug which engages the feeler 55 of a microswitch 56 to close the switch when bell crank 54 is subjected to a sufficient counterclockwise torque as viewed in FIG. 1.

Figure 2:
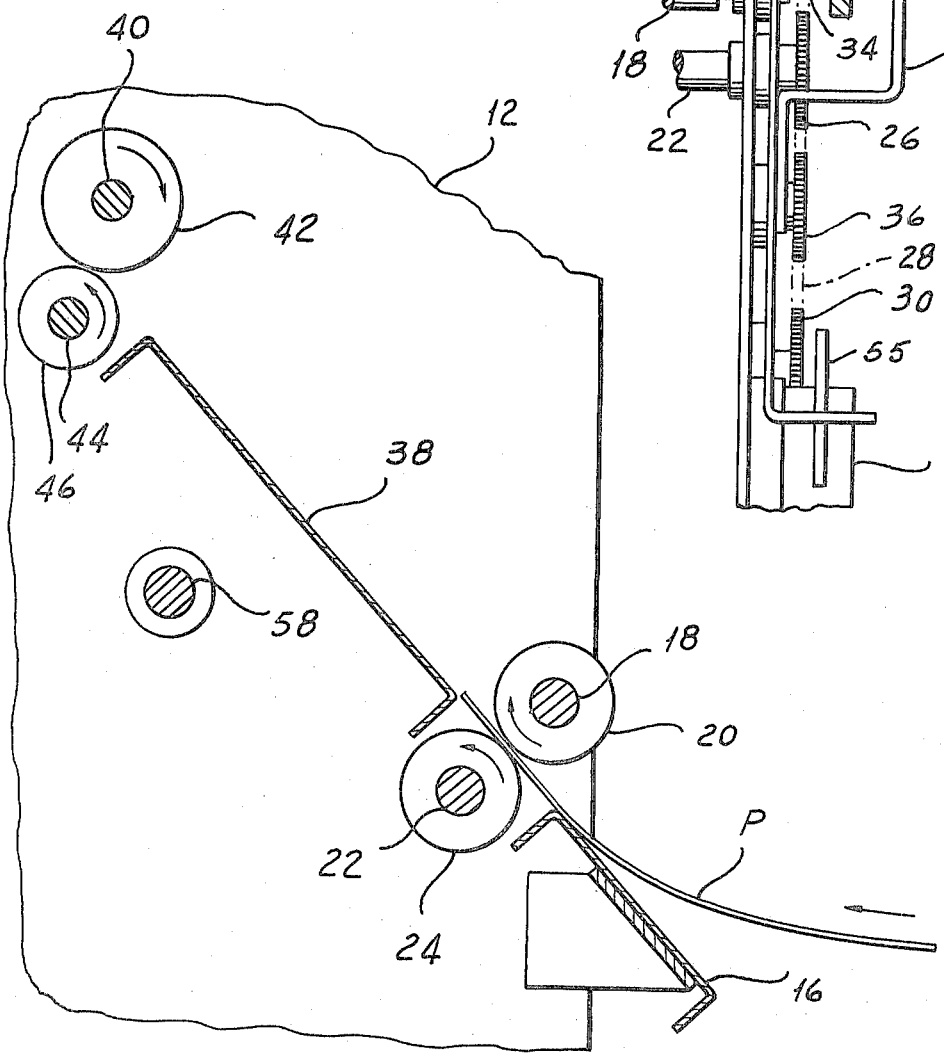
FIG. 2 is a fragmentary section of the sheet detector shown in FIG. 1, illustrating the paper feed path.

I so adjust the relative speeds of roller assembly shafts 22 and 44 that rollers 46 drive a sheet at a linear speed slightly greater than the speed at which it is driven by rollers 24. As a result, whenever a single copy sheet is engaged by both sets of rollers 20 and 24 and rollers 42 and 46, shaft 44 experiences a retarding torque tending to rotate it clockwise as viewed in FIGS. 1 and 2. As a result of this torque, gear 48 exerts a greatly increased counterclockwise torque on bell crank 54 around shaft 58, which counterclockwise torque urges the lower end of bell crank 54 against the feeler of microswitch 56 with sufficient pressure to actuate the switch. Bell crank 54 and its associated assembly thus act as a torque detector for sensing the existence of a drag torque on shaft 44 due to the presence of a copy sheet spanning rollers 20 and 24 and rollers 42 and 46. When the trailing edge of the copy sheet emerges from the nip formed by rollers 20 and 24, the retarding torque is no longer present. As a result, since bell crank 54 ceases to press against the feeler microswitch 56 with sufficient pressure to actuate the switch, the switch reopens.

It will be seen that I have accomplished the objects of my invention. My sheet detector is positive and reliable in operation without causing sheets to be misfed. My sheet detector is simple and inexpensive and is especially suited for detecting the movement of sheet edges past a pair of feed rollers.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing said tension to produce an indication of the simultaneous presence of said sheet in the nips of said first and second pairs of feed rollers.

2. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing said tension to produce an indication of the simultaneous presence of said sheet in the nips of said first and second pairs of feed rollers, said sensing means providing a first output in response to any tension below a predetermined level and providing a second output in response to any tension above said predetermined level.

3. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing the torque transmitted to one of said feed rollers by said driving means to produce an indication of the simultaneous presence of said sheet in the nips of said first and second pairs of feed rollers.

4. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing said tension to produce an indication of the simultaneous presence of said sheet in the nips of said first and second pairs of feed rollers, said driving means including a first gear, means for rotating said first gear, a second gear coupled to one of said feed rollers, and an intermediate gear engaging said first and second gears, said sensing means including means for supporting said intermediate gear for rotation on an axis, means mounting said supporting means for translational movement of said axis in response to tension in said sheet, and means for sensing translational movement of said axis.

5. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing said tension to produce an indication of the simultaneous presence of said sheet in the nips of said first and second pairs of feed rollers, said driving means including a first gear, means for rotating said first gear, a second gear coupled to one of said feed rollers, and an intermediate gear engaging said first and second gears, said sensing means including an arm supporting said intermediate gear for rotation on a first axis, means mounting said arm for pivotal movement about a second axis spaced from said first axis in response to tension in said sheet, and means for sensing pivotal movement of said arm.

6. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such different speeds as to advance one of said sheets along said path while producing a tension in said sheet between said first and second pairs of rollers, and means for sensing said tension to produce an indication of the simultaneous presence of said sheet in the nips of said first and second pairs of feed rollers, said driving means including a first gear, means for rotating said first gear, a second gear coupled to one of said feed rollers, and an intermediate gear engaging said first and second gears, said sensing means including means for supporting said intermediate gear for planetary motion about one of said first and second gears and means for sensing the torque exerted by said intermediate gear about said one of said first and second gears.

7. A detector as in claim 6 in which said intermediate gear is supported for planetary motion about said first gear.

8. A detector as in claim 6 in which said torque-sensing means comprises a pressure-sensitive switch.

9. In apparatus in which sheets of relatively inextensible material are advanced along a path, a detector for sensing the position of one of said sheets along said path including in combination first and second pairs of opposing feed rollers arranged at spaced locations along said path, each of said pairs of rollers forming a nip for positively gripping one of said sheets, means for driving said first and second pairs of feed rollers at such a constant speed ratio as to advance one of said sheets along said path while producing a tension in said sheet between said first and second pairs of rollers, and means for sensing said tension to produce an indication of the simultaneous presence of said sheet in the nips of said first and second pairs of feed rollers.

* * * * *